United States Patent [19]

Lee

[11] Patent Number: 4,653,784

[45] Date of Patent: Mar. 31, 1987

[54] SPRING-LOADED OSCILLATING CAM LATCH

[76] Inventor: Raymond J. Lee, 109 Arden Ave., So. San Francisco, Calif. 94080

[21] Appl. No.: 867,054

[22] Filed: May 27, 1986

[51] Int. Cl.[4] ..... E05C 19/02

[52] U.S. Cl. ..... 292/71; 292/DIG. 61

[58] Field of Search ..... 292/336.3, 71, 76, 78, 292/DIG. 61, 347, 79

[56] References Cited

U.S. PATENT DOCUMENTS

| | | | |
|---|---|---|---|
| 2,552,390 | 5/1951 | Bacon et al. | 292/78 |
| 2,626,170 | 1/1953 | Nottingham | 292/78 |
| 3,201,160 | 8/1965 | Lewin | 292/71 |
| 4,230,352 | 10/1980 | Sealey et al. | 292/347 |
| 4,569,547 | 2/1986 | Fayerman et al. | 292/DIG. 61 X |

*Primary Examiner*—Richard E. Moore

*Attorney, Agent, or Firm*—Alfons Puishes

[57] ABSTRACT

A latch mechanism comprising a latch plate spring biased to a central position by a coil spring located in an opening in the plate. Ends of the spring are held against two stationary pins which extend through arcuate slots to guide the plate.

3 Claims, 7 Drawing Figures

SPRING-LOADED OSCILLATING CAM LATCH

BACKGROUND OF THE INVENTION

Many mechanisms have been devised for installation on cabinet doors and the like to provide positive locking of the doors in closed position while permitting convenience in operation of the door. An important feature often sought to be attained is to make it harder to open the door than to close it to discourage unauthorized access. Other objectives are simplicity in operation, manufacture and construction, as well as installation. The closest art to the invention of the applicant is set forth below.

Bacon, U.S. Pat. No. 2,552,390 employs a cam faced latch employing a coiled spring which works through a link and lever machanism so that the action of the spring is to hold the latch against the catch when opening the door and aid the operation of the latch when closing the door.

Nottingham, U.S. Pat. No. 2,626,170 likewise uses a spring, in this case a leaf spring, operating against a pin in a slot in the cam so that because of the configuration of the latch member, the combined action of the spring and pin against it also requires more force to open and to close.

Sealey, U.S. Pat. No. 4,230,352 uses a complicated combination of rollers, latches and cam, the rollers being spring-loaded so that pressure externally on the door is transmitted through the linkage to release the catch and permit the door to open.

While applicant also employs a spring, cam, and rollers or pins, he uses them in an entirely different combination and configuration so that the method of operation of his latch differs entirely from that of the prior art as will be evident from the description below.

SUMMARY OF THE INVENTION My invention entails the use of a single moving part comprising a body member which includes the housing for spring, stationary pins and cam shaped latch member which is exceedingly simple in construction, offers ease of operation and installation and when installed on a cabinet door or the like makes it harder to open the door than to close it.

DETAILED DESCRIPTION OF THE INVENTION

Located through the body are oppositely spaced arcuate slots 2A and 2B. These slots engage stationary pins 3A and 3B respectively upon which the body 1 oscillates back and forth within slots 2A and 2B.

Centrally located through the body 1 is circular opening 1C which communicated with milled recesses 1A and 1B. These are provided to receive helical spring 4 with its ends 4A and 4B protruding through the recesses 1A and 1B respectively to engage the stationary pins 3A and 3B mentioned above.

The catch unit 6 here shown attached to the door of a cabinet as described below, but such a catch unit may be part of any other mechanical movement which it is desired to latch and unlatch.

Forming an integral part of body 1 is tongue 7 having a convex cam surface 7A which operates on opening of the door and flat surface 7B which operates on closing of the door, the surfaces meeting at catch point P as described more fully below.

Figure 1:
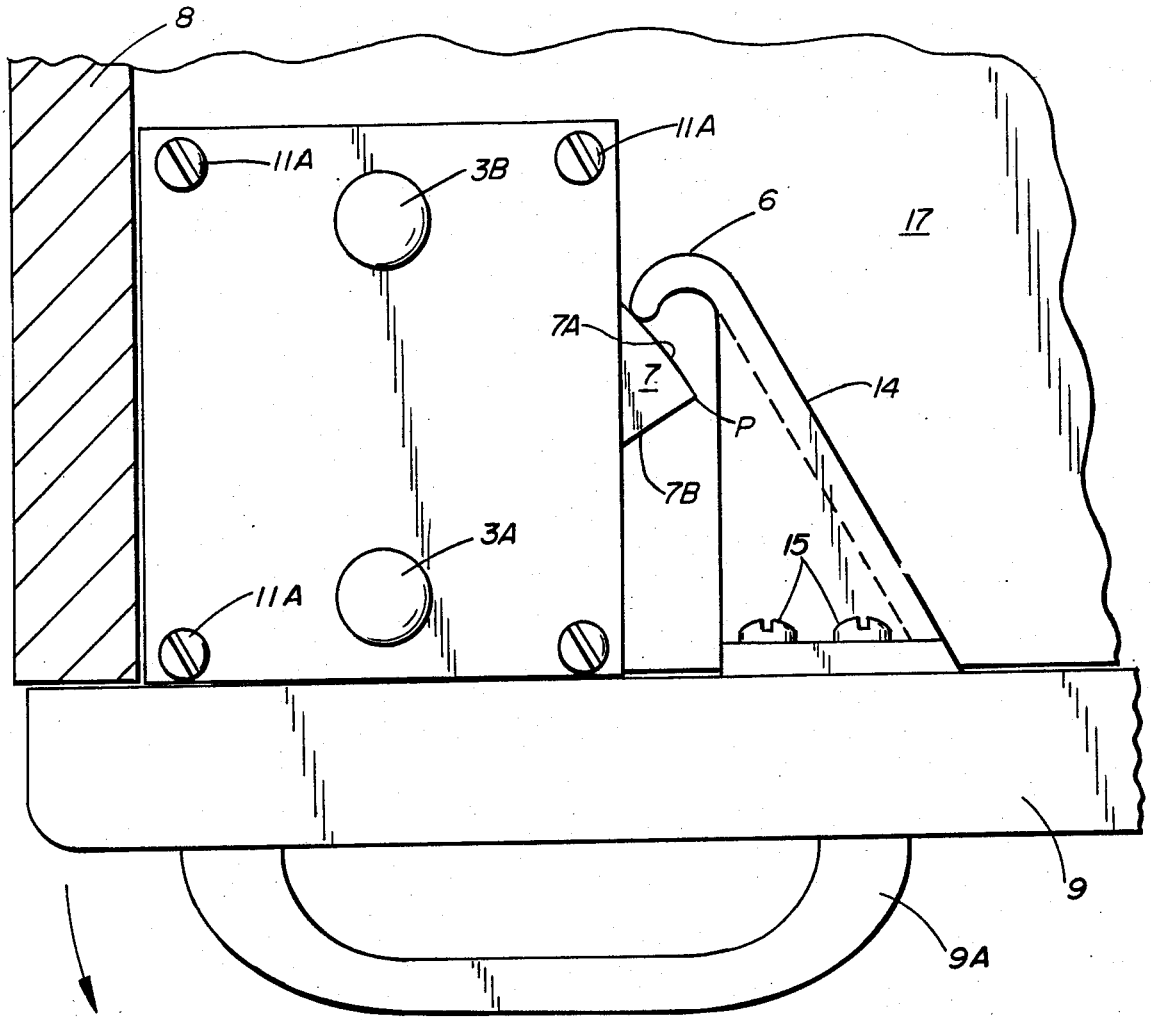
FIG. 1 is a top view of a cabinet partly in section showing my device installed in a cabinet.

The installation of my device on a cabinet is best seen on FIG. 1 wherein 8 shows the side of the cabinet, 9 the door and 9A the handle.

Figure 2:
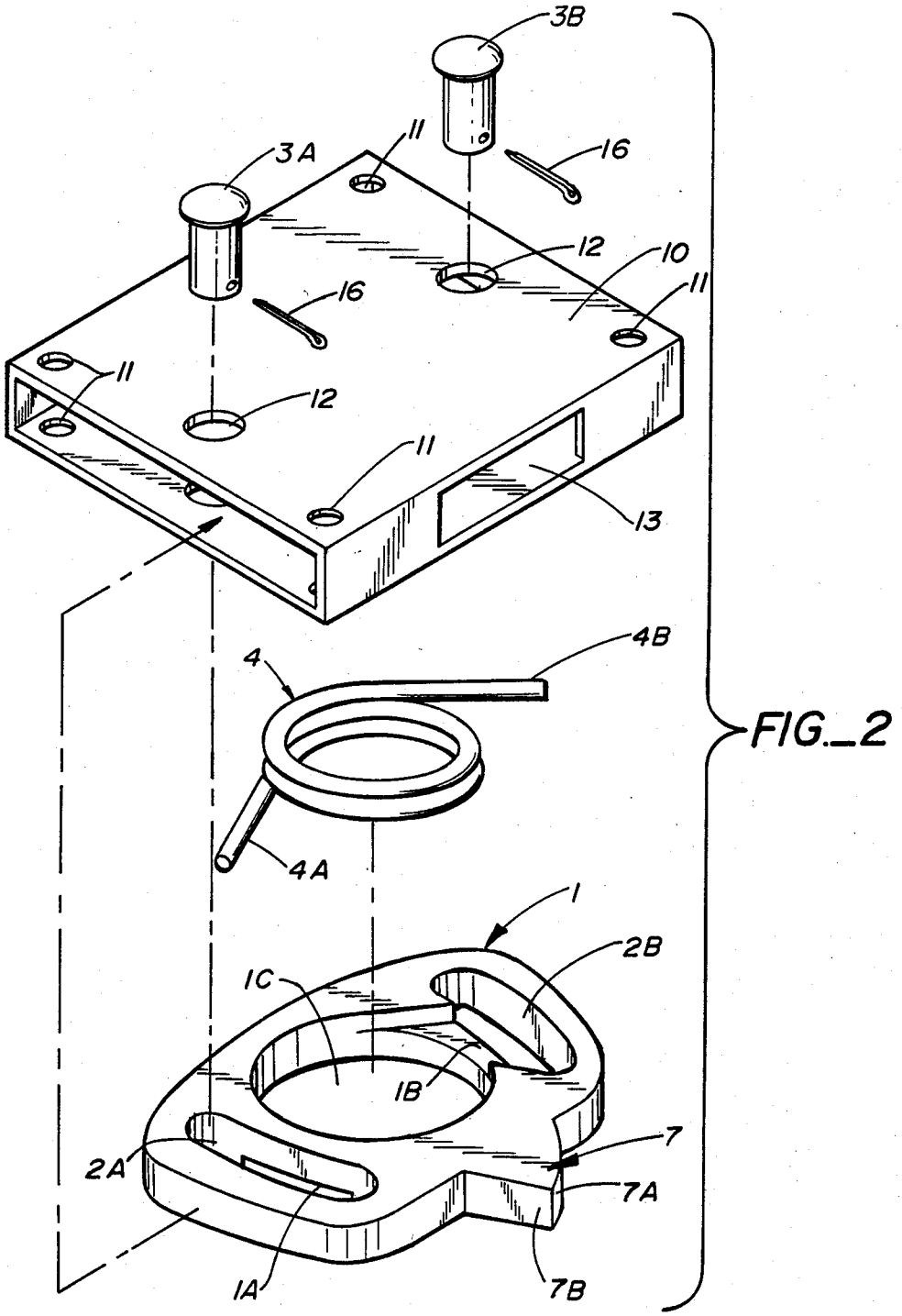
FIG. 2 is an upper right frontal exploded perspective of my device.
Figure 3:
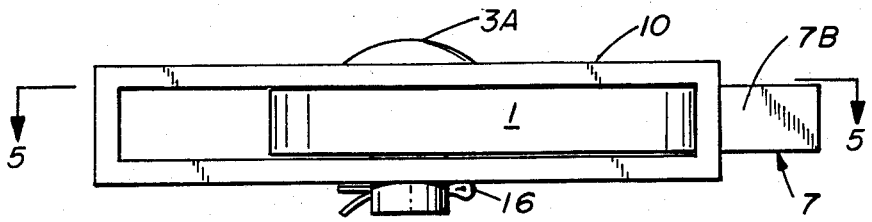
FIG. 3 is a right side view of the assembly.
Figure 4:
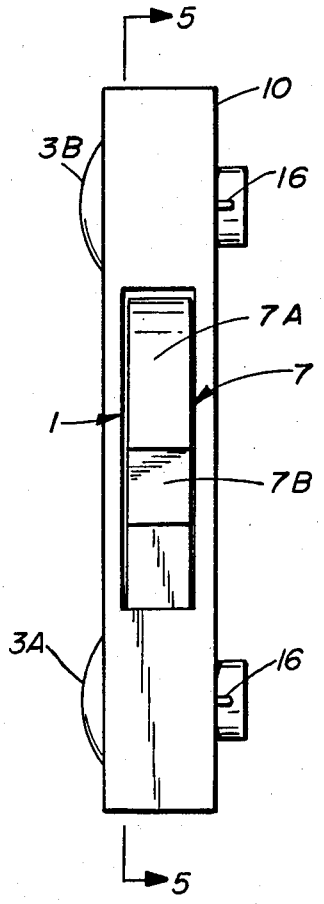
FIG. 4 is a front view of the assembly.

As employed in this embodiment, the body 1 is located within latch housing 10 in which there is a snug sliding fit. The housing is provided with holes 11 through which screws 11A effect fastening of the device to the floor of the cabinet 17. Holes 12 in the housing permit the insertion of pins 3A and 3B which are further held in position by cotter pin 16 after passing through their respective slots in body 1, namely 2A and 2B respectively, all of which may be clearly seen on FIG. 2. There is also shown there, opening 13 in the housing 4 permitting the protrusion of tongue 7 for engagement with catch member 6. The latter is supported by bracket 14 which in turn is fastened to door 9 by screws 15.

It should be noted that tongue 7 is located eccentrically to body 1 so that convex surface 7A is closer to pin 3B than flat surface 7B is to pin 3A. The reason for this will be apparent from a description of the operation of my device set forth below.

OPERATION

Figure 6A:
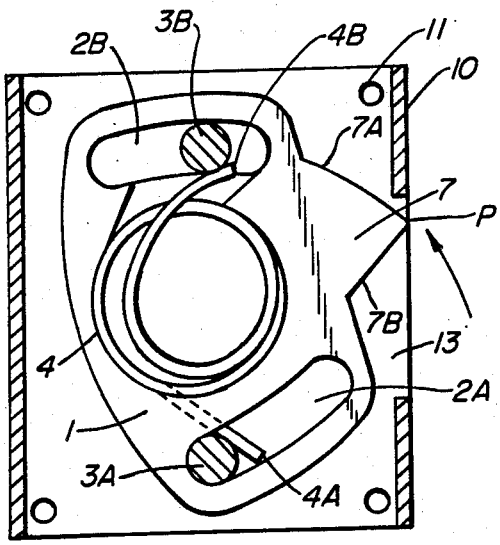
FIG. 6A shows the position of the mechanism when closing the door.
Figure 6B:
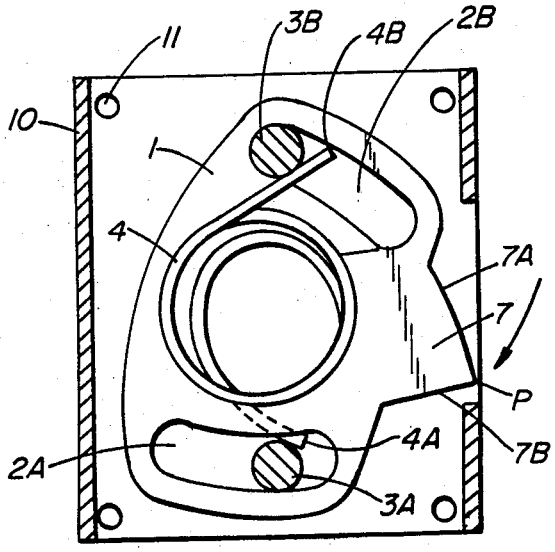
FIG. 6B shows the position of the mechanism when opening the door.
Figure 5:
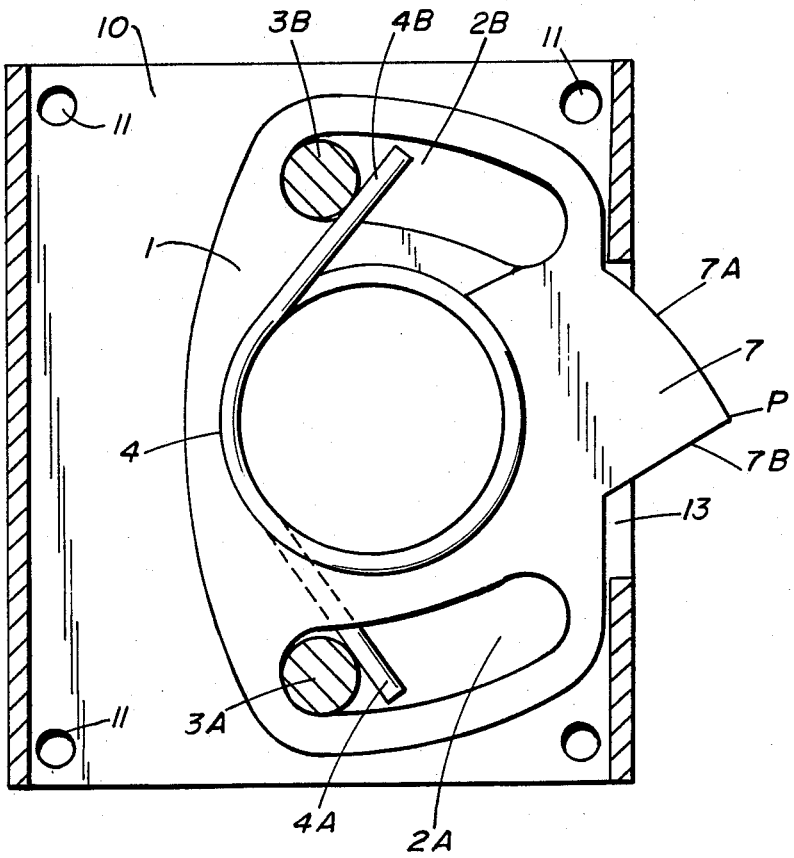
FIG. 5 is a top sectional view along lines 5—5 showing the basic mechanism in position in a housing.

Referring again to the figures, at the start of the operation the door 9 is in closed position and catch member 6 is positioned against tongue 7 as shown in FIG. 1, the body of the latch being in a central or normal position as shown in the section view of FIG. 5. When opening door 9, catch member 6 is caused to move against convex surface 7A and rotate the entire body 1 around pin 3B and against the action of spring 4 against pin 3A. This is best seen on FIG. 6B. After catch member 6 passes catch point P, the tongue member is released and the action of spring 4 causes the body to spring back again to its normal central position of FIG. 1 or FIG. 5. Door 9 is then free to swing wide open. When closing, the door is brought back until catch member 6 contacts flat surface 7B of tongue 7. Further movement of the door rotates body 1 around pin 3A and against the action of pin 3B against spring 4. This is best seen on FIG. 6A. Here again, after catch point P is passed, body 1 by the action of spring 4 is caused to spring back so that tongue 7 is again in a neutral or central position, catch member 6 being moved back to its initial closed position shown on FIG. 1.

When the door is being opened, catch member 6 has a moment arm of the distance between where it makes contact to convex surface 7A and where spring end 4B contacts pin 3B. This is resisted by the wing 4A of spring 4, having its moment arm from the contact point between pin 3A and the contact point between pin 3B and spring end 4B. When closing, the catch member has a moment arm of the distance from where it contacts flat surface 7B to the contact point between pin 3A and spring end 4A. This is much greater than the corresponding moment arm on closing, mentioned above. Consequently, there will be considerably less force required to move tongue 7 in this direction and consequently to close the door than it took to open it. Moreover, since 7A is convex, the moment arm on opening increases slower since it is not increasing as rapidly as it is when a contact point is moving along the straight line represented by 7B which further increases the difference in amount of force required to open the door in comparison to what it takes to close it. It should now be apparent that all this is accomplished through the use of only one moving part in the latch itself in contrast to the more complicated mechanisms employed in the prior art.

I claim:

1. A latch mechanism comprising:

a flat rotating body member;

a pointed tongue member forming a part of said body member and protruding from one side thereof;

said body member having a central circular opening therethrough;

a first arcuate slot and a second arcuate slot positioned through said body member on opposite sides thereof;

said slots being disposed to slideably engage a first stationary pin and a second stationary pin respectively;

a helical spring positioned axially in said central circular opening;

opposite ends of said spring engaging said pins;

said tongue member having a first surface adjacent to said first pin and a second surface adjacent to said second pin on opposite sides of said body;

said first and said second surface being disposed to intersect each other defining a peak at the outer end of said tongue;

said tongue being normally held in a central position by the action of said spring on said pin;

a catch member engaging said tongue and disposed to move transversely to said tongue while engaging one of said surfaces thereby imparting a rotary motion to said tongue away from said central position about the pin adjacent to said surface and against the action of said spring against the oppositely space pin until said catch member passes said peak in said tongue thereby releasing said catch member and permitting the action of said spring against said pin to cause said tongue to spring back to said normal central position.

2. The device of claim 1 in which said first surface of said tongue is convex and said second surface of said tongue is flat, said tongue being so positioned on said body that said first surface is closer to the pin adjacent to said first surface than said second surface is to the pin adjacent to said second surface thereby requiring more force to be exerted in moving said catch member along said first surface against the action of said spring than required to move said second catch member along said second surface.

3. The device of claim 1 or claim 2 including:

a housing for containing said body and permitting said tongue to protrude therefrom;

a cabinet having a swinging door;

means for fastening said housing to the floor within said cabinet;

means for fastening said catch member to said door;

said housing being so positioned that said convex first surface of said tongue engages said catch member when said door is closed;

a handle for said door;

whereby said catch member may be moved to engage said first convex surface upon opening of said door and against said second surface upon closing of said door.

* * * * *